US007694494B2

(12) United States Patent
Bornemeier et al.

(10) Patent No.: US 7,694,494 B2
(45) Date of Patent: Apr. 13, 2010

(54) TREE SUPPORT AND COVER SYSTEM

(75) Inventors: Erik D. Bornemeier, Bountiful, UT (US); Jared Hendricks, Draper, UT (US)

(73) Assignee: Treekeeper, LLC, West Valley, UT (US)

( * ) Notice: Subject to any disclaimer, the term of this patent is extended or adjusted under 35 U.S.C. 154(b) by 683 days.

(21) Appl. No.: 11/125,892

(22) Filed: May 10, 2005

(65) Prior Publication Data

US 2006/0255230 A1 Nov. 16, 2006

(51) Int. Cl.
*B26D 7/27* (2006.01)

(52) U.S. Cl. ..... 53/396; 53/389.2; 53/393

(58) Field of Classification Search ..... 53/396, 53/393, 389.2, 255; 47/40.5, 84
See application file for complete search history.

(56) References Cited

U.S. PATENT DOCUMENTS 2,911,025 A * 11/1959 Paros ..... 206/423
3,924,669 A * 12/1975 Price ..... 206/423
4,054,166 A 10/1977 Burke
4,206,795 A 6/1980 Regan
4,384,604 A * 5/1983 DeLaura et al. ..... 206/423
4,799,520 A * 1/1989 Blackburn et al. ..... 206/423
4,969,555 A * 11/1990 Fitzgerald ..... 206/423
5,291,999 A 3/1994 Phair
5,323,558 A 6/1994 Baumler
5,388,799 A 2/1995 Keefe
5,590,775 A 1/1997 Moore
5,746,317 A 5/1998 Turner et al.
D497,832 S 11/2004 Glover
2004/0262183 A1 12/2004 Gildart
2007/0284273 A1* 12/2007 Bornemeier et al. ..... 206/423

FOREIGN PATENT DOCUMENTS

CA 2433204 12/2003

* cited by examiner

*Primary Examiner*—Sameh H. Tawfik
(74) *Attorney, Agent, or Firm*—Michael F. Kriger; Kirton & McConkie

(57) ABSTRACT

The present invention relates to a tree support and cover system. One embodiment of the present invention relates to a tree stand configured for efficient transportation of a tree. The tree stand includes two sets of wheels for use in translating the tree. A first set of wheels is disposed below the tree stand and allows for conventional translation with an erect tree. A second set of wheels is disposed on the side of the tree stand and allows for tipped translation. The tree stand may also include an optional electrical system with one or more electrical items including a timer, a Ground Fault Interrupter outlet, a remote controlled positioning system, etc. A second embodiment of the present invention relates to a collapsible tree cover that can be used to efficiently transport and store the tree. The collapsible tree cover can be concealed within a tree stand or used as a skirt when it is collapsed below the tree. The tree cover includes at least one adjustable expansion system with an elastically biased opening for use in reducing the diameter of the tree. The tree cover includes at least one storage opening which can be used to store items around the trunk of the tree when the tree cover is extended over the tree. The tree stand and tree cover embodiments can also be used in conjunction with one another to provide additional features.

4 Claims, 9 Drawing Sheets

TREE SUPPORT AND COVER SYSTEM

BACKGROUND

1. Field of the Invention

The present invention relates to a tree support and cover system. More particularly, the present invention relates to a tree stand and collapsible cover configured for efficient transportation and storage of a tree.

2. Background of the Invention and Related Art

It has become tradition to raise and decorate a Christmas tree throughout the Christmas holiday. Part of this tradition involves lighting and displaying the tree in a well traveled location. Trees are typically decorated with ornaments, candy, and electrical lights. The electrical lights are strung around the tree and plugged into a wall outlet.

Artificial trees have become more popular over the last 10 years because of the environmental concern, annual expense, and cleanup required with living trees. Living trees shed leaves/needles once they are cut and typically deposit a large amount of these needles over the course of the holiday season. In addition, a living tree cannot be used more than one season because it will dry out and die. Living trees must also be disposed of at the end of the season. Likewise, many people have ethical or environment objections to cutting down a 20 year old tree for a one to three month period and then disposing of it.

Artificial trees can be used multiple times, require no water, are typically lighter, and do not shed needles. However, artificial trees must still be stored during the non-Christmas season. Conventional artificial trees occupy a large amount of space and are difficult to efficiently store between uses. Some types of artificial trees include the ability to break apart into smaller and more manageable pieces. In addition, the branches of some artificial trees may be able to hinge or collapse to further minimizing its size. Despite these improvements, it is still inconvenient to store a tree between uses.

During the Christmas season, trees are erected with a tree stand that provides support and stability to the tree. It is often necessary to move the entire tree from one location to another. Therefore, numerous tree stands are equipped with wheels and other portability systems. However, conventional portability systems are designed for direct translation of the tree. This type of movement can be difficult if the tree is very heavy or densely decorated.

Accordingly, there is a need in the industry for an improved tree support and cover system that allows for efficient transportation and storage of the tree.

SUMMARY OF THE INVENTION

The present invention relates to a tree support and cover system. One embodiment of the present invention relates to a tree stand configured for efficient transportation of a tree. The tree stand includes two sets of wheels for use in translating the tree. A first set of wheels is disposed below the tree stand and allows for conventional translation with an erect tree. A second set of wheels is disposed on the side of the tree stand and allows for tipped translation. The tree stand may also include an optional electrical system with one or more electrical items including a timer, a Ground Fault Interrupter outlet, a motorized translation system, etc. A second embodiment of the present invention relates to a collapsible tree cover that can be used to efficiently transport and store the tree. The collapsible tree cover can be concealed within a tree stand or used as a skirt when it is collapsed below the tree. The tree cover includes at least one adjustable expansion system with an elastically biased opening for use in reducing the diameter of the tree. The tree cover includes at least one storage opening which can be used to store items around the trunk of the tree when the tree cover is extended over the tree. The tree stand and tree cover embodiments can also be used in conjunction with one another to provide additional features.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The present invention relates to a tree support and cover system. One embodiment of the present invention relates to a tree stand configured for efficient transportation of a tree. The tree stand includes two sets of wheels for use in translating the tree. A first set of wheels is disposed below the tree stand and allows for conventional translation with an erect tree. A second set of wheels is disposed on the side of the tree stand and allows for tipped translation. The tree stand may also include an optional electrical system with one or more electrical items including a timer, a Ground Fault Interrupter outlet, a remote controlled positioning system, etc. A second embodiment of the present invention relates to a collapsible tree cover that can be used to efficiently transport and store the tree. The collapsible tree cover can be concealed within a tree stand or used as a skirt when it is collapsed below the tree. The tree cover includes at least one adjustable expansion system with an elastically biased opening for use in reducing the diameter of the tree. The tree cover includes at least one storage opening which can be used to store items around the trunk of the tree when the tree cover is extended over the tree. The tree stand and tree cover embodiments can also be used in conjunction with one another to provide additional features. While embodiments of the present invention are directed at a tree support and cover system, it will be appreciated that the teachings of the present invention are applicable to other areas.

As used in this specification, the following terms are defined accordingly:

"tree"—any living or artificial decorative tree including a Christmas tree;

"tree stand"—any device used to support a tree;

"tree cover"—a properly shaped cover configured to completely cover the exterior of a tree;

"skirt"—is a flexible material draped around the trunk of a tree;

"elastically-biased opening"—is an opening that is biased into a closed configuration with some form of elastic device.

Reference will now be made to the figures in order to describe embodiments of the present invention.

Figure 1:
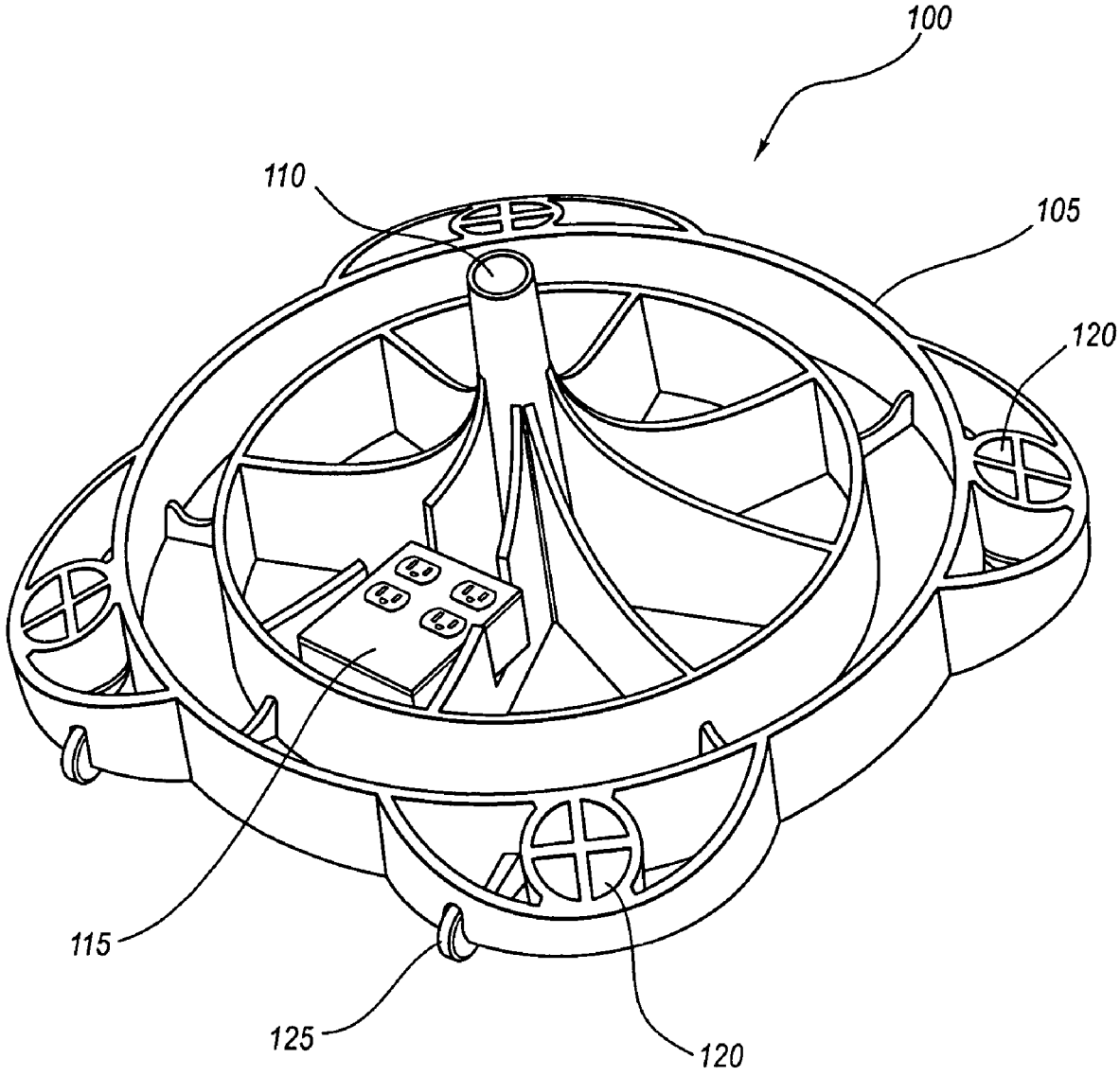
FIG. 1 illustrates a perspective view of a tree stand in accordance with one embodiment of the present invention.

Reference is initially made to FIG. 1, which illustrates a perspective view of a tree stand in accordance with one embodiment of the present invention. The tree stand is designated generally at 100. The tree stand 100 includes a base 105, a first set of wheels 120, a second set of wheels 125, an electrical system 115, and a trunk holder 110. The base 105 is shaped in a generally circular shape in order to provide a solid platform upon which to support a tree. The illustrated base 105 includes multiple recesses which can be used to install additional accessories or for under-tree storage. The shape of the base 105 also provides a gently sloping platform under a tree which can be covered by a skirt and used for traditional present storage. Various other base 105 shapes and designs may be used and remain consistent with the present invention.

The first set of wheels 120 includes four castor style wheels which are disposed below the base at four substantially equidistant locations. The wheels 120 are equidistant from the center of the base 105 and equally spaced from one another on the perimeter of the base 105. The illustrated base 105 includes recesses to conceal the wheels 120. The first set of wheels 120 are configured to support the entire weight of the tree stand 100 and a corresponding tree (not shown). The illustrated castor style wheels provide the ability to directly translate the tree stand 100 in a flat configuration in any two dimensional direction. However, any type of wheels may be used with the tree stand 100 and remain consistent with the present invention.

The second set of wheels 125 includes two wheels disposed on a side portion of the base 105, as illustrated. The side portion location of the second set of wheels 125 does not contact the ground unless the base 105 is tipped to one side. The tipped configuration involves transferring the weight of the tree stand 100 from the first set of wheels 120 to the second set of wheels 125. Therefore, the second set of wheels 125 can be used to dolly or translate the tree stand 100 and corresponding tree (not shown) in a tipped configuration. Translating the tree stand 100 and corresponding tree in a tipped configuration provides additional maneuverability and is described in more detail with reference to FIGS. 5A-C.

The electrical system 115 is also disposed on the base in a manner to remain substantially flush with the overall shape of the tree stand 100. The electrical system 115 is designed to provide numerous electrical features required on many trees for use in holiday celebration. Many trees are decorated with electrical lights. The electrical system 115 may include an outlet, a GFI, a timer, a light dancing computer, a remote controlled positioning system, or any other electrical accessory for use with a tree. The outlet and/or Ground Fault Interrupter allow one or more electrical accessories to be plugged in directly at the tree stand 100 rather than extending multiple cords to a wall outlet. A single corresponding cord is necessary to provide AC current to the outlet. This allows the unsightly appearance of electrical cords to be minimized or concealed. In addition, a timer can be incorporated into the electrical system 115 to ensure that all electrical devices are turned off during times of non-use to avoid fire danger and minimize electrical usage. A light dancing computer could also be incorporated into the electrical system 115 to be used in conjunction with a set of lights, such that the lights can be programmed to dance, flash, strobe, etc. In addition, a remote controlled positioning system can be coupled between the electrical system 115 and the first set of wheels 120. The remote controlled positioning system could include a motor and a radio frequency communication device that would allow a user to remotely translate the tree stand 100 while viewing the aesthetic location of the tree in relation to its surroundings. Various other electrical accessories may be incorporated into the electrical system 115 of the tree stand 100 and remain consistent with the present invention.

The trunk holder 110 is shaped and coupled to the base 105 in a manner to provide support of a tree via the trunk. The illustrated trunk holder 110 is an elongated cylindrical member configured to receive a sufficient portion of a tree trunk in order to reliably support the tree in an erect position. Various types of adjustable diameter trunk holder technologies may be incorporated and remain consistent with the present invention. For example, the trunk holder may include a plurality of adjustable members that extend perpendicularly to the trunk in order to constrict around the exact dimensions of the trunk.

Figure 2:
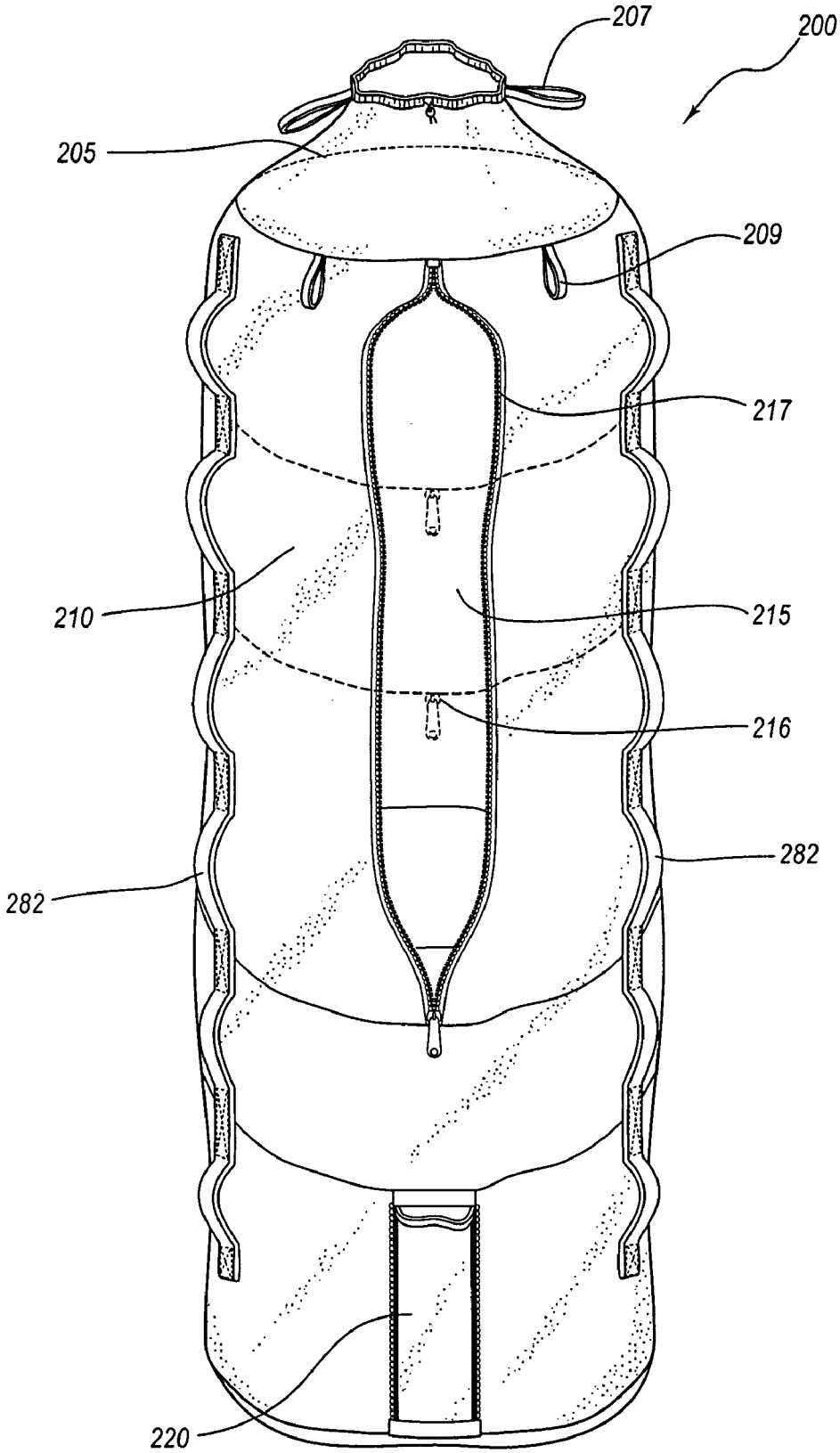
FIG. 2 illustrates a perspective view of a tree cover in accordance with one embodiment of the present invention.

Reference is next made to FIG. 2, which illustrates a perspective views of a tree cover in accordance with one embodiment of the present invention. The tree cover is designated generally at 200. The tree cover 200 further includes a cylindrically configured material 210, at least one adjustable expansion system 215, a cinching system 205, a storage opening 220, and a plurality of transportation handles 222 and extension handles 209. The tree cover 200 may be coupled to any type of tree stand including the tree stand embodiment illustrated in FIG. 1. The tree cover 200 is designed to be adjustable between a compressed or collapsed configuration at the bottom of a tree and an extended or covered configuration which completely engulfs a tree. The process of manipulating the tree cover 200 between the compressed and extended configurations will be discussed in more detail with reference to FIGS. 3A-3E. In addition, a detailed discussion of various components of the illustrated tree cover 200 embodiment will be discussed with reference to FIGS. 4A-4C.

The cylindrically shaped material 210 includes one or more rectangular material pieces coupled in a manner to form a substantially cylindrical shape. For example, two rectangular halves could be coupled lengthwise to form a cylindrical shaped piece of material. The material is any flexible yet durable material or combination thereof including various nylon blends, Cordura, plastic, etc. The illustrated embodiment incorporates a material that is puncture resistant yet flexible enough to facilitate compression and expansion of the tree cover 200. The cylindrically configured material 210 includes an opening on the top and the bottom. A semi rigid ring may be coupled to one or both of these openings to provide stability and ensure that the proper shape of the tree cover 200 is maintained. These rings may be coupled and concealed on the internal side of the cylindrically shaped material 210.

The at least one adjustable expansion system 215 includes a resealable opening that can be used to temporarily expand the diameter dimension of the cylindrically shaped material 210. It may be important to expand this dimension during the processes of transferring the tree cover 200 from a compressed configuration to an extended configuration or vice versa. Likewise, the adjustable expansion system 215 is also used to minimize the diameter dimension of the tree when it is compressed. If the tree cover 200 is used to store an artificial tree, the adjustable expansion system 215 is configured to engage with a branch hinge system that minimizes the diameter of the artificial tree. The illustrated adjustable expansion system 215 includes an elastically biased opening extending lengthwise on the cylindrically shaped material 210, a closing system coupled to an external portion of the elastically biased opening, and a piece of material coupled to an interior portion of the elastically-biased opening. These components form an adjustable louvered opening. The elastically biased opening is a lengthwise opening on the cylindrically shaped material 210 that is biased with an elastic material into a closed configuration. This elastic bias can be accomplished with one or more strips of elastic material extending between the two sides of the opening. The illustrated closing system includes a zipper which provides additional adjustability in that the zipper controls the length of the adjustable expansion system thereby providing a user the option to only expand a portion of the adjustable expansion system. In addition, a piece of material is coupled to the interior portion of the elastically biased opening. The piece of material prevents the tree from extending out of the opening and assists in compressing the tree into the cylindrically shaped material 210 when the adjustable expansion system 215 is closed. The illustrated adjustable expansion system 215 also includes two elastic cinching strings 216 which extend around the cylindrically shaped material 210 and can be adjustably cinched by a pair of D rings sewn to the piece of material coupled to the interior portion of the elastically biased opening.

The cinching system 205 is disposed on the top opening of the cylindrically shaped material 210. The cinching system 205 includes a rectangular piece of material coupled to the top opening and a slidable drawstring 207 coupled to a top side of the rectangular piece of material. The rectangular piece of material is also coupled to itself and the top opening in a manner to form a cylindrical shape. However, the slidable draw string can manipulate the rectangular piece of material between a cone shaped cinched configuration and a cylindrical shaped expanded or open configuration. The rectangular piece of material may be composed of any durable material or combination thereof.

The storage opening 220 is disposed at the lower portion of the cylindrically shaped material 210, as shown. The storage opening 220 allows items to be stored around the trunk of the tree but retained within the tree cover 200. For example, this region could be used to store all accessories needed to display a Christmas tree including lights, decorations, etc. Likewise, various electrical components such as extension cords or the like may be stored in this region. One embodiment of the detailed features of the storage opening 220 will be discussed in more detail with reference to FIG. 4A.

The plurality of transportation handles 282 and extension handles 209 are used to assist users in transporting and extending the tree cover 100, respectively. The illustrated transportation handles 282 are disposed near the lengthwise center of the cylindrically shaped material 210 to facilitate a relatively balanced carrying load. FIG. 3E illustrates how the transportation handles 282 can be used to support the weight of the tree cover 100. The transportation handles 282 are rectangular pieces of material stitched on either end to the cylindrically shaped material 210 thereby forming a handle. The illustrated extension handles 209 are disposed on the edge of the top opening of the cylindrically shaped material 210. The extension handles 209 can be used to assist a single person in extending the tree cover 200 from a collapsed configuration into an extended configuration. This process will be described in more detail below with reference to FIGS. 3A through 3E.

Figure 3A:
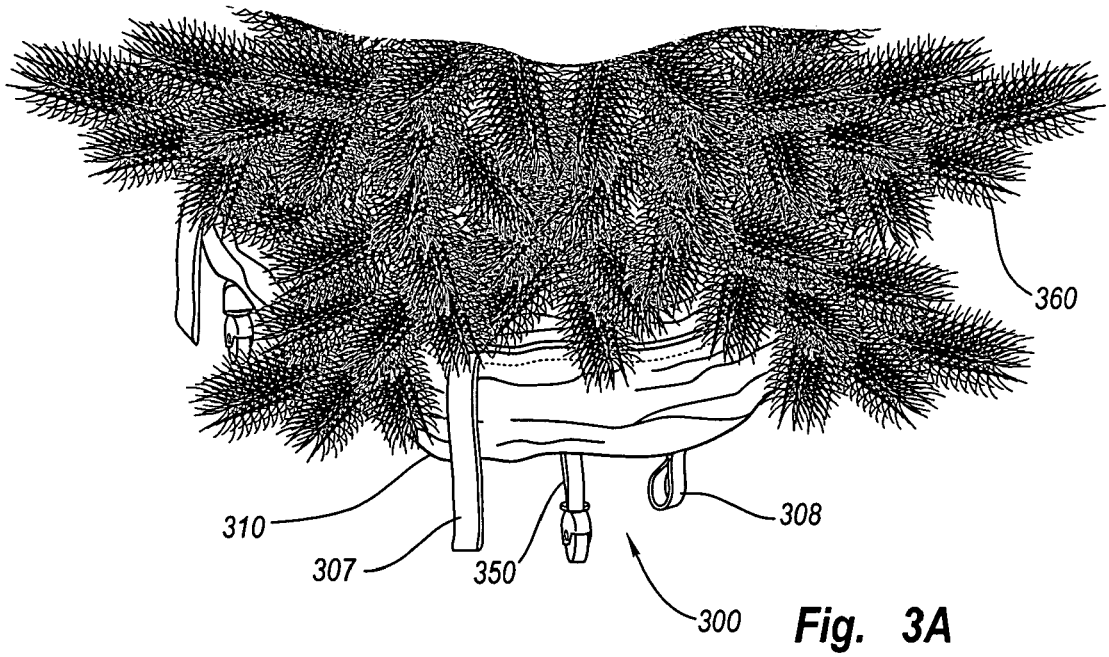
FIGS. 3A-E illustrate perspective views of a tree cover being coupled to a conventional tree stand, extended over a tree and prepared for transportation in accordance with one embodiment of the present invention.
Figure 3B:
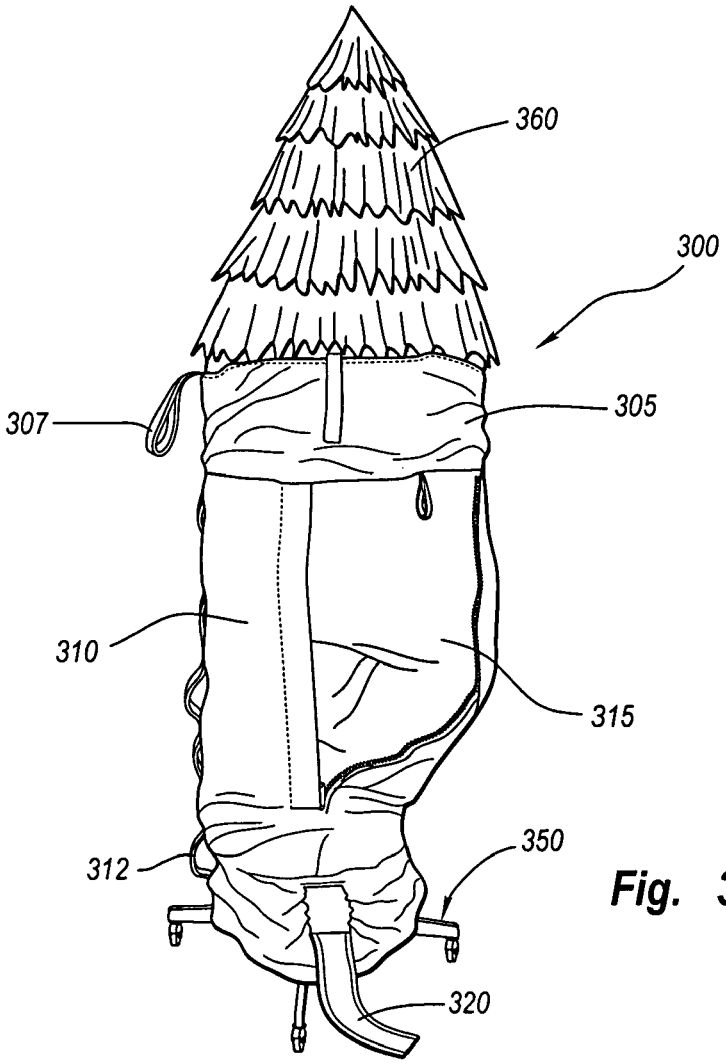
Figure 3C:
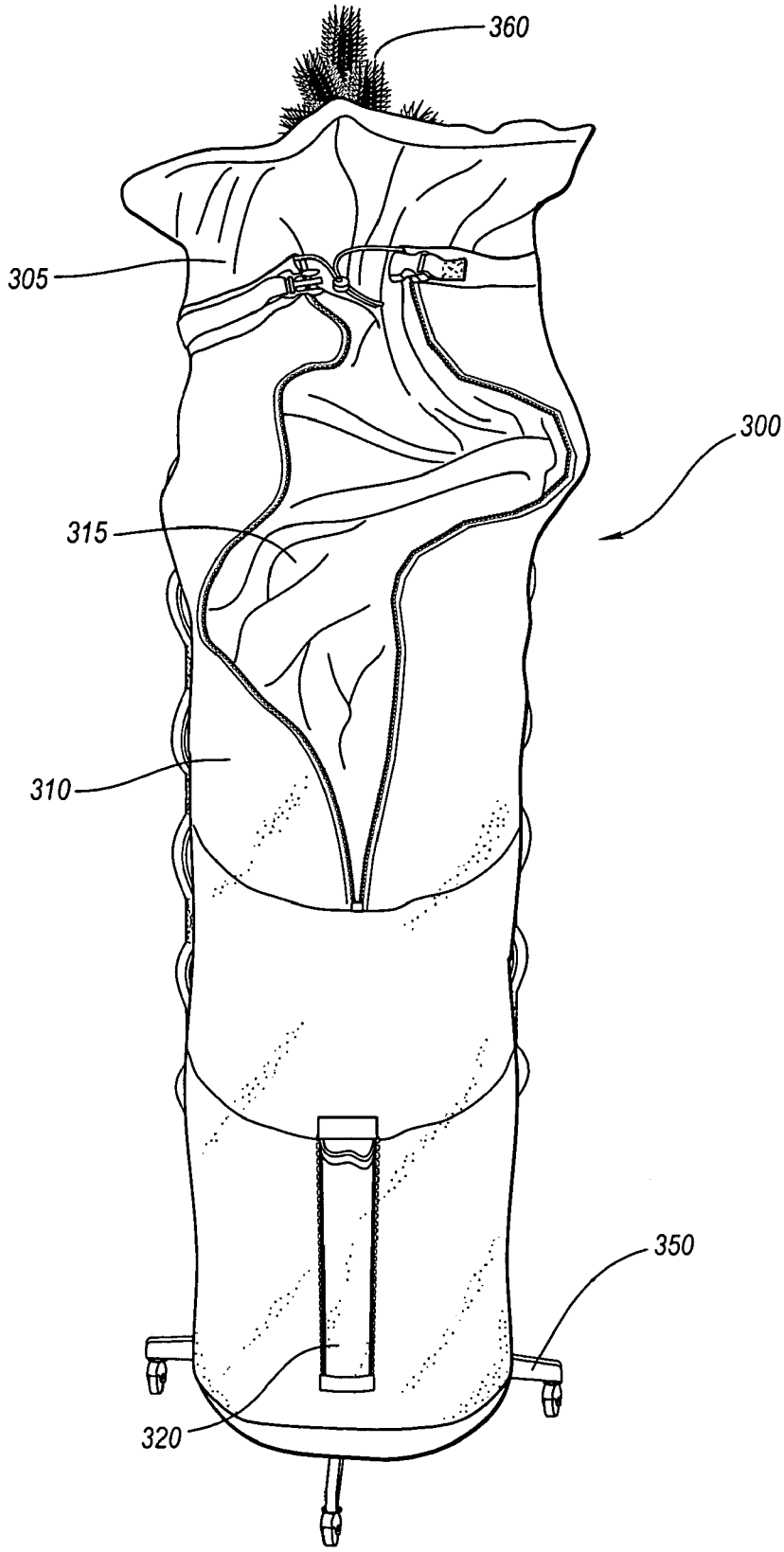
Figure 3D:
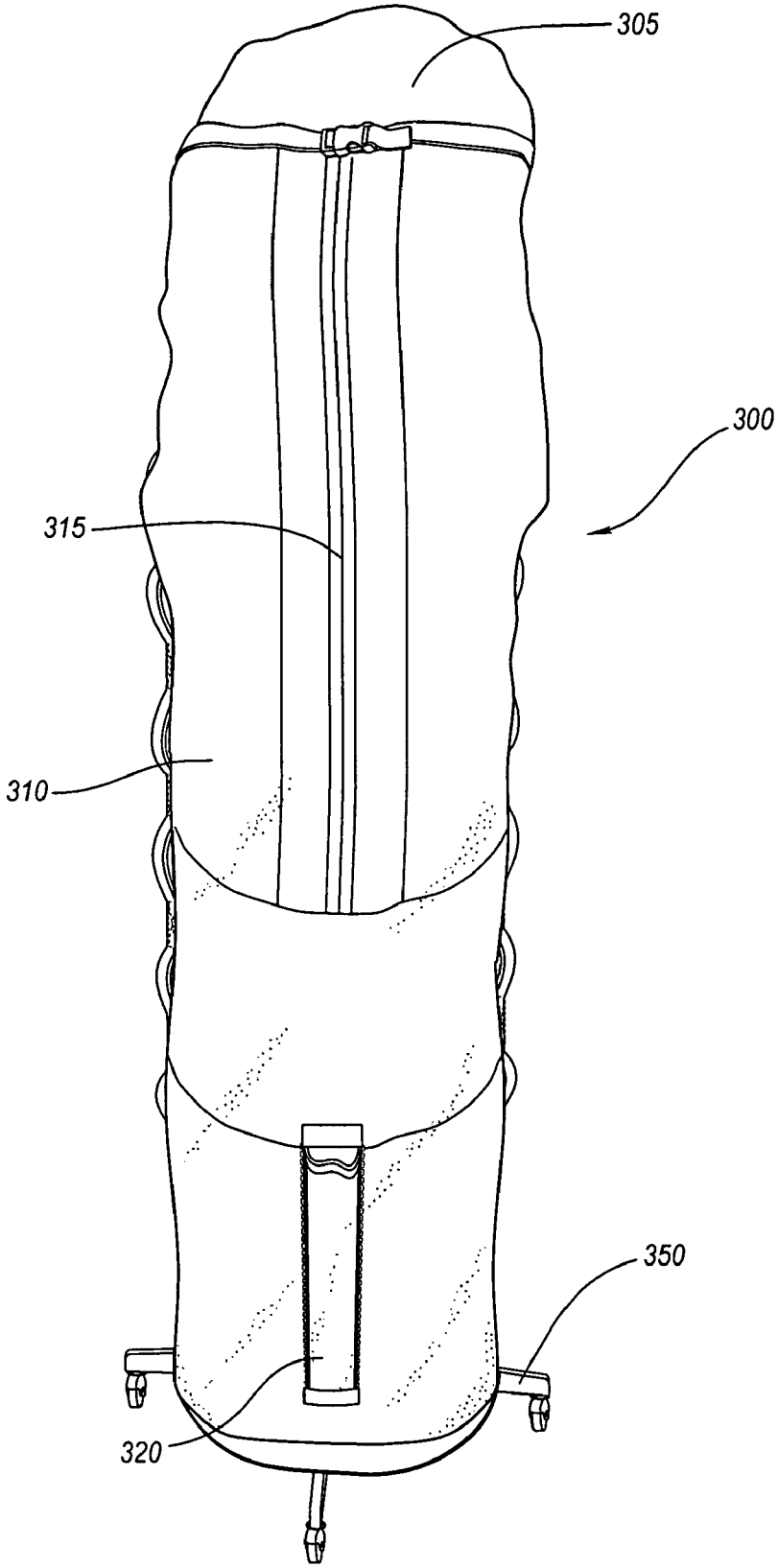
Figure 3E:
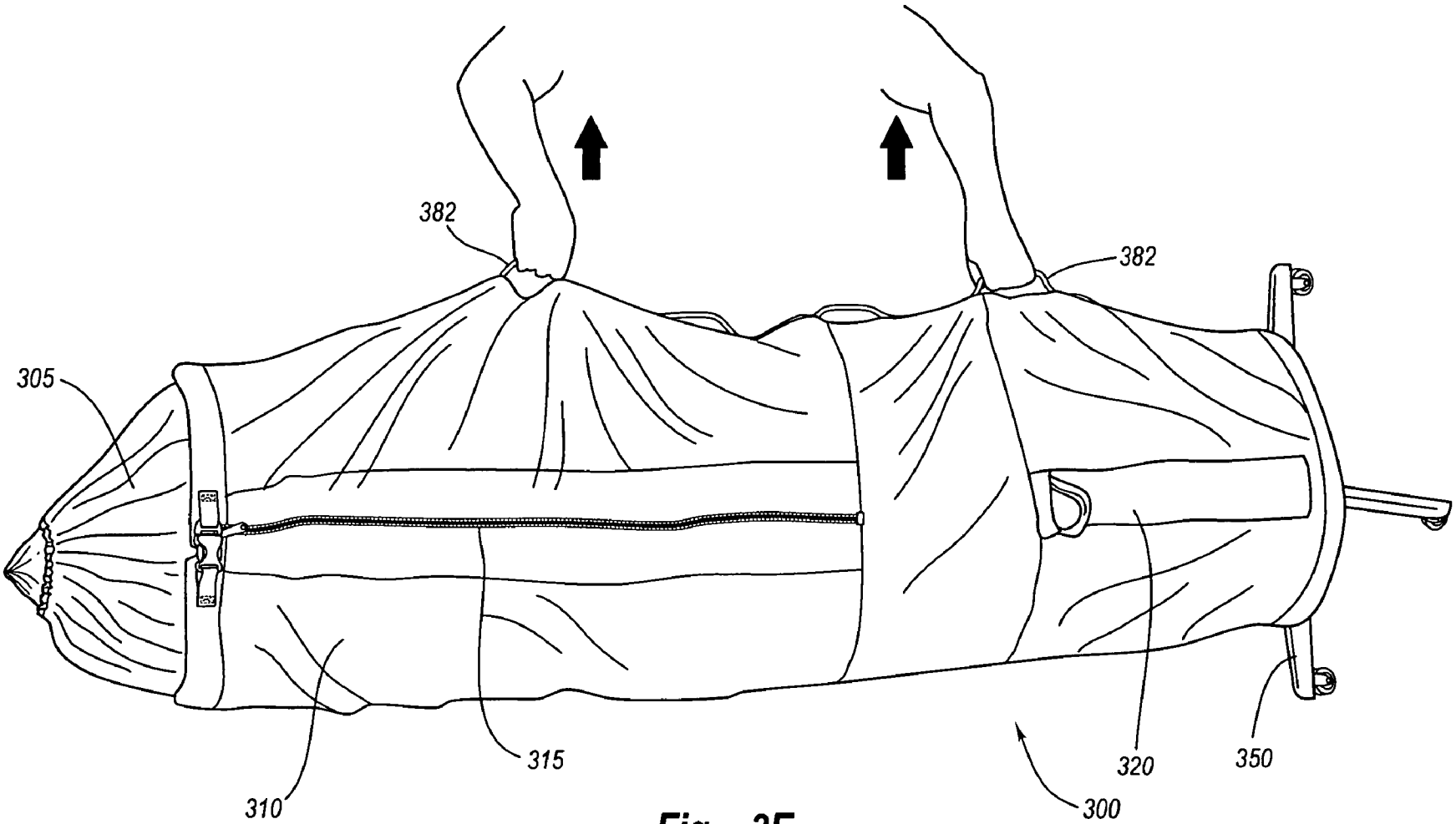

Reference is next made to FIGS. 3A-E, which illustrate perspective views of a tree cover being coupled to a conventional tree stand, extended over a tree from a collapsed configuration, and prepared for transportation in accordance with one embodiment of the present invention. The tree cover is designated generally at 300. The tree stand and tree used to demonstrate the process of extending the tree cover 300 from a collapsed configuration to an extended configuration and are designated at 350 and 360 respectively. Reference is first made to FIG. 3A which illustrates the tree cover 300 in a collapsed configuration between the tree 360 and the tree stand 350. The cylindrically shaped material 310 is shown collapsed into a relatively flat dimension. The extension handles 309 and cinching system 305 drawstring 307 are also visible in this configuration. Reference is next made to FIG. 3B which illustrates a partially extended configuration of the tree cover 300. The illustrated tree cover 100 has been extended over a portion of the tree 360 while remaining coupled to the tree stand 350. It should be noted that the adjustable expansion system 315 is in the expanded configuration to assist in raising the tree cover 300 over the tree 360. The extension handles 309 may be used to efficiently extend the tree cover 300 over the remainder of the tree 360. The storage opening 320 is open but can be closed when the tree cover 300 is completely extended over the tree. The drawstrings 307 of the cinching system 305 are not used until the tree cover 300 is completely extended over the tree 360. Reference is next made to FIG. 3C which illustrates the tree cover 300 being further extended to top of the tree 360. The adjustable expansion system 315 is still illustrated in an expanded configuration but must next be collapsed in order to prepare the tree cover 300 and tree 360 for transportation. Likewise, the cinching system 305 must also be cinched using the drawstrings 307 to prepare the tree cover 300 and tree 360 for transportation. The storage opening 320 is now illustrated in a closed configuration thereby effectively storing any items around the trunk of the tree 360. Reference is next made to FIG. 3D, which illustrates a completely extended tree cover 300 that covers the tree 360 and is prepared for transportation. The adjustable expansion system 315 has been collapsed by zipping up the zipper thereby causing the overall diameter of that portion of the tree cover 300 to be compressed. Likewise, the cinching system 305 has been cinched over the top of the tree 360 effectively covering the top of the tree 360. Reference is next made to FIG. 3E which illustrates the tree cover 300 being prepared for transportation using the transportation handles 382.

Figure 4A:
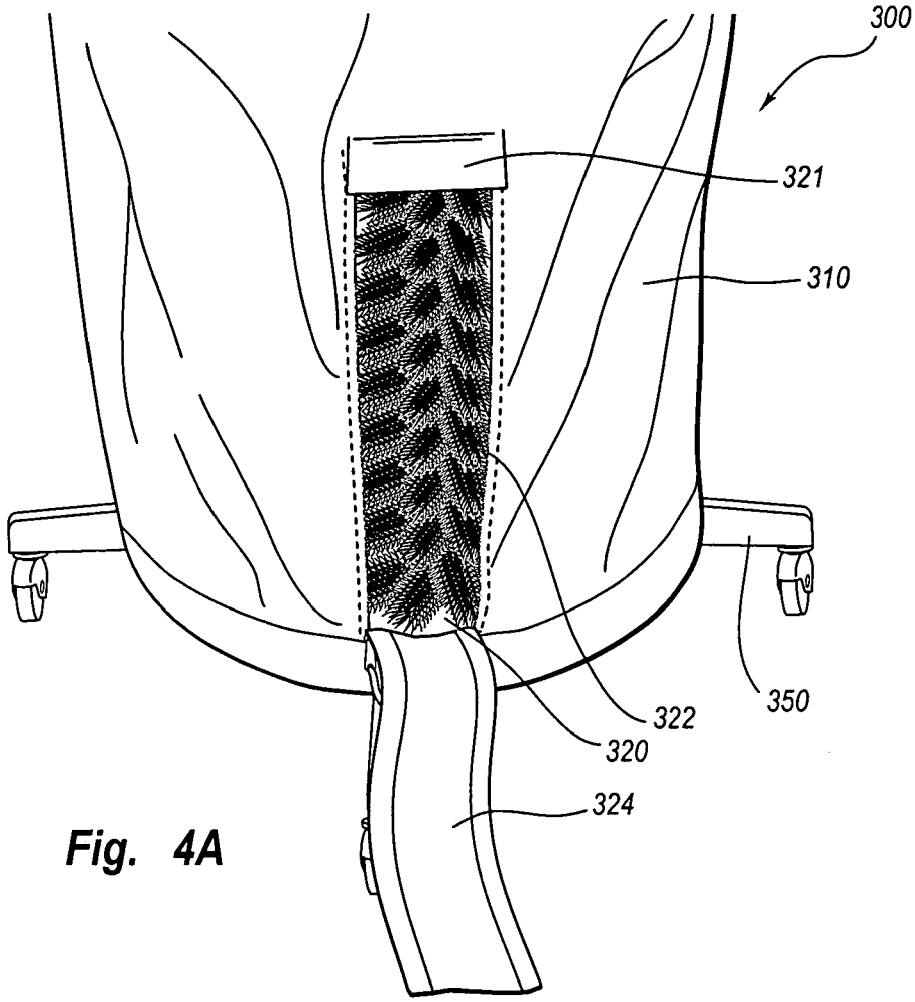
FIG. 4A illustrates a detailed perspective view of the storage opening on the tree cover embodiment illustrated in FIGS. 3A-E, and wherein the tree cover is in the extended configuration.

Reference is next made to FIG. 4A, which illustrates a detailed perspective view of the storage opening on the tree cover embodiment illustrated in FIGS. 3A-E, and wherein the tree cover is in the extended configuration. The storage opening is designated generally at 320. The storage opening includes a dual zipper closing system 322, a main flap 324, and a top flap 321. The illustrated storage opening 320 is shaped in a vertical rectangular orientation with a sufficient width to allow a user to insert their hand for access. The dual zipper closing system extends vertically on either side of the recess to facilitate releasably sealing the sides of the flap 324 around the opening in the cylindrically shaped material 310. The top portion of the flap 324 is covered by the top flap 321. The top flap 321 also prevents the storage opening from snagging on an object as the tree cover is horizontally brushed by.

Figure 4B:
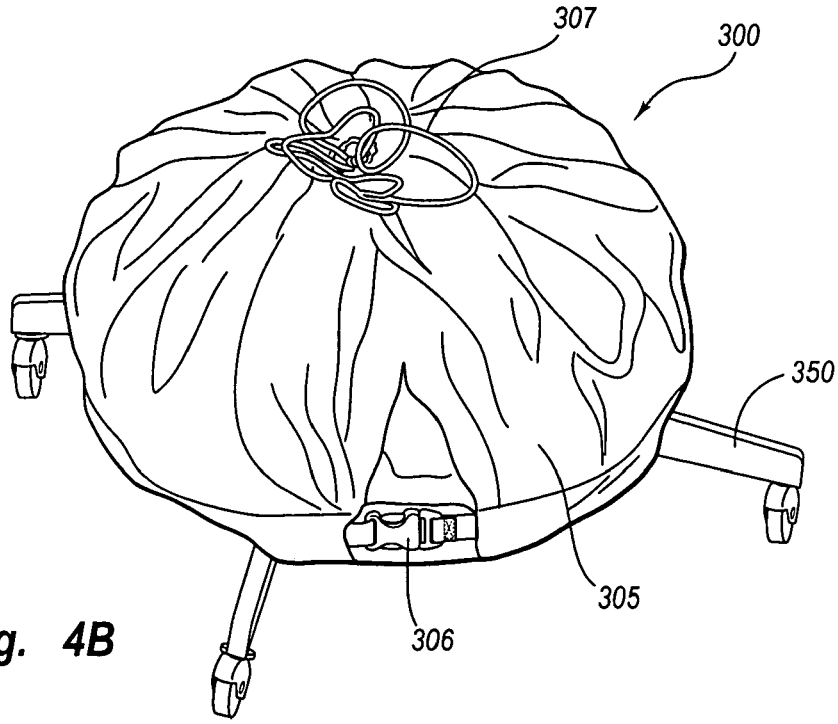
FIG. 4B illustrates a detailed perspective view of the tree cover embodiment illustrated in FIGS. 3A-E in a collapsed configuration over a conventional tree stand.

Reference is next made to FIG. 4B, which illustrates a detailed perspective view of the tree cover embodiment illustrated in FIGS. 3A-E in a collapsed configuration over a conventional tree stand without a tree. The tree cover is designated generally at 300 and the tree stand at 350. This is an alternative collapsed configuration in which the tree cover 300 may be stored without the tree 360. The tree cover 300 is compressed into a relatively flat dimension and the cinching system 305 is cinched shut via the drawstring 307. An additional buckle 306 is used to maintain the collapsed configuration of the tree cover 300.

Figure 4C:
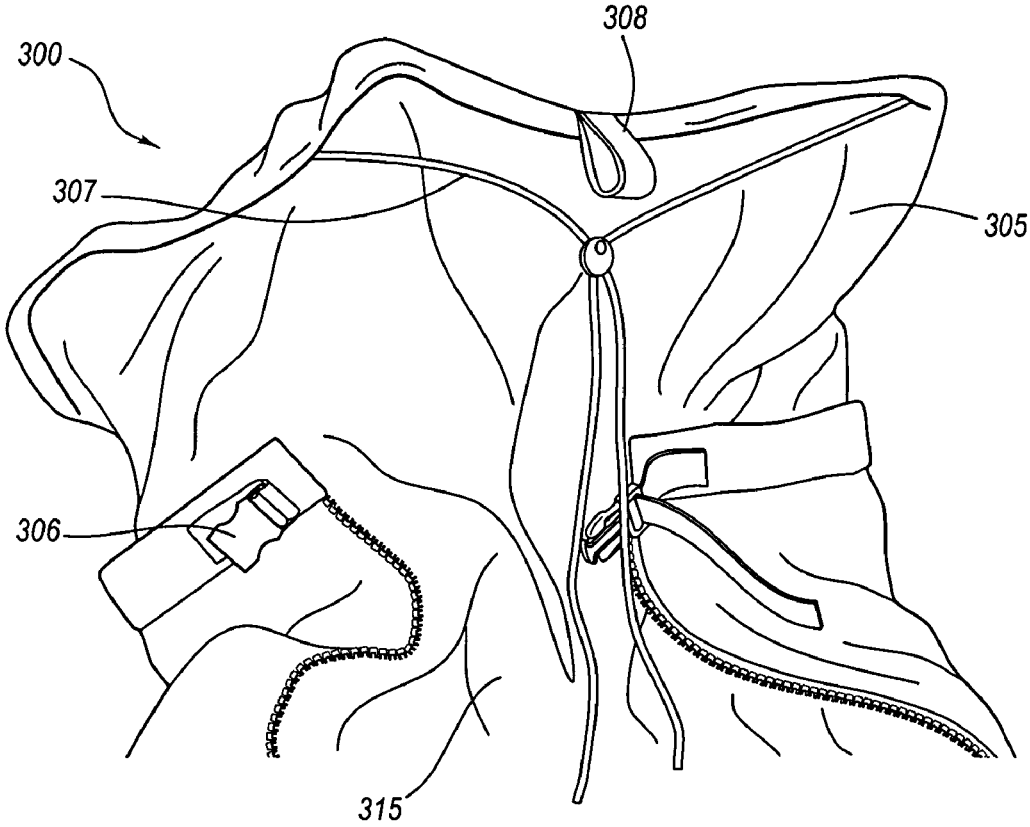
FIG. 4C illustrates a detailed perspective view of the cinching system of the tree cover embodiment illustrated in FIGS. 3A-E.

Reference is next made to FIG. 4C, which illustrates a detailed perspective view of the cinching system of the tree cover embodiment illustrated in FIGS. 3 A-E. The tree cover is designated generally at 300. The cinching system 305 includes a rectangular piece of material coupled to the top opening and a slidable drawstring 307 coupled to a top side of the rectangular piece of material. The rectangular piece of material is also coupled to itself and the top opening in a manner to form a cylindrical shape. However, the slidable draw string 307 can manipulate the rectangular piece of material between a cone shaped cinched configuration and a cylindrical shaped expanded or open configuration. The rectangular piece of material may be composed of any durable material or combination thereof. The buckle 306 can be used to provide additional cinching capabilities and for storage purposes as illustrated in FIG. 4B. Additional cinching handles 308 may be coupled to the top of the cinching system 305 for use in extending the cinching system 305 over the top portion of a tree.

Figure 5A:
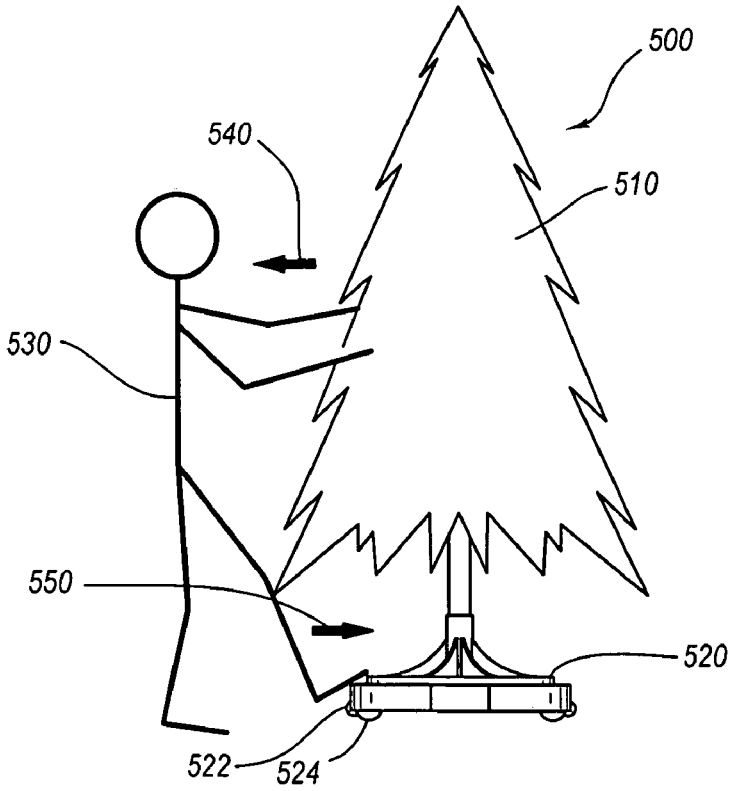
FIGS. 5A-C illustrate profile views of a tree being transported in a tipped configuration utilizing a second set of wheels on the tree stand in accordance with one embodiment of the present invention.
Figure 5B:
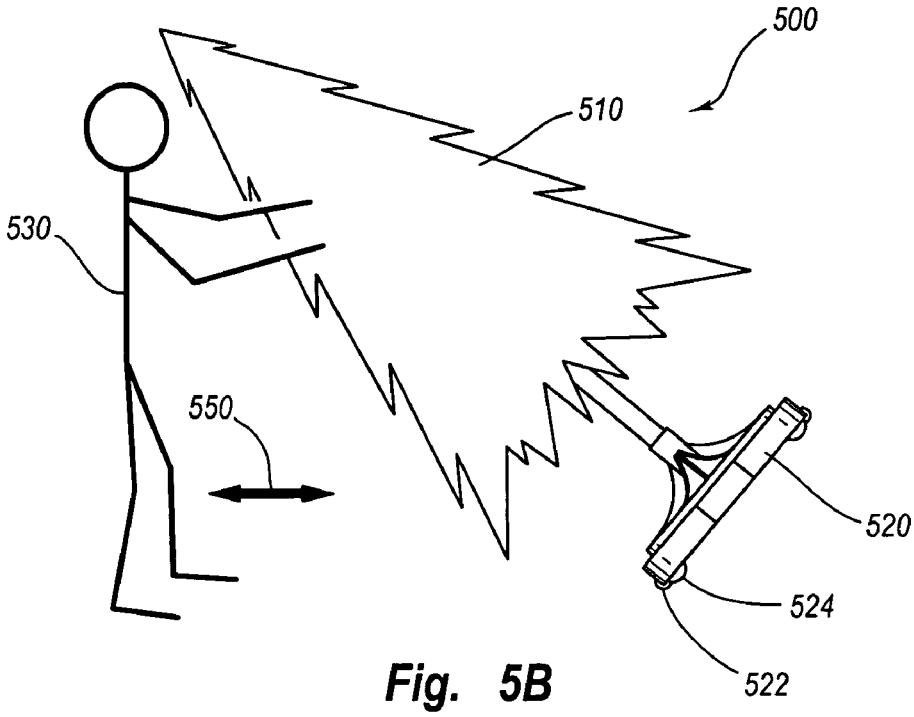
Figure 5C:
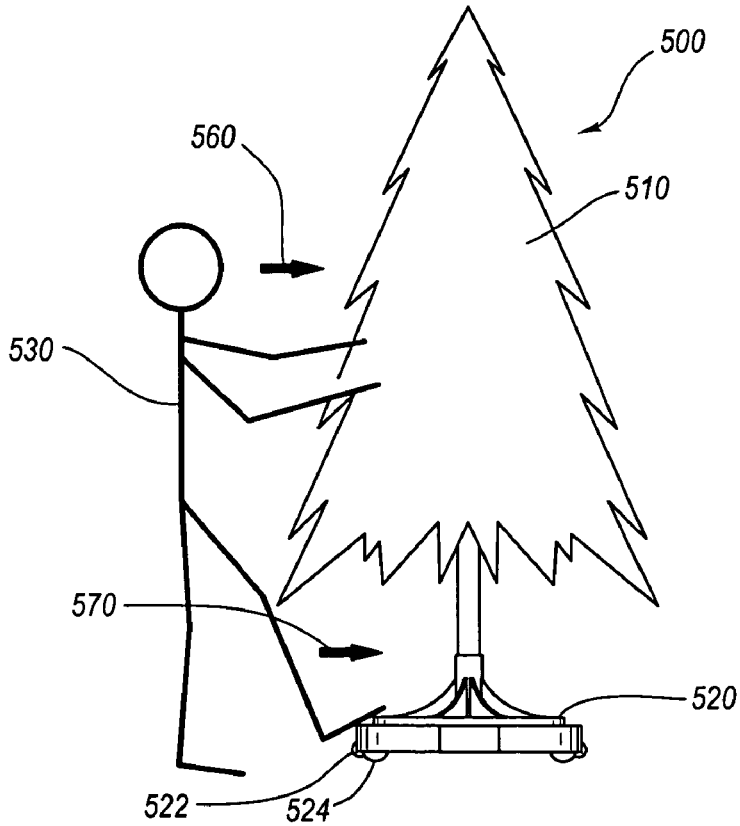

Reference is next made to FIGS. 5A-C, which illustrate profile views of a tree being transported in a tipped configuration utilizing a second set of wheels on the tree stand in accordance with one embodiment of the present invention. The system is designated generally at 500. The system includes a tree 510, a tree stand 520, and a user 530. The tree stand 520 includes a first set of wheels 524 disposed below the tree stand 520 in a manner to allow for lateral translation of the tree 510 in an erect position. The tree stand 520 also includes a second set of wheels 522 disposed on a side of the tree stand 520 in a location that does not contact the ground unless the tree stand 520 is tipped to one side. Reference is first made to FIG. 5A, which illustrates the tree 510 in an erect configuration in which the first set of wheels 524 can be used to translate the tree 510 and tree stand 520. If the first set of wheels 524 are castor style wheels, the translation can be in any two dimensional direction. The user 530 is applying a pulling force 540 on the tree 510 and a stabilizing or pushing force 550 on the tree stand in order to put the tree 510 and tree stand 520 in a tipped configuration as shown in FIG. 5B. Reference is next made to FIG. 5B, in which the tree 510 and tree stand 520 are in a tipped configuration in which only the second set of wheels 522 are engaged. In this configuration, the user 530 can easily translate the tree 510 in any direction. In addition, the weight of the tree 510 is balanced on the two wheels of the second set of wheels 522 which allows for convenient maneuverability as represented by variable force 545. Reference is next made to FIG. 5C in which the user 530 is returning the tree 510 and tree stand 520 to an erect position by applying a releasing or pushing force 560 on the tree 510 and a pushing or stabilizing force 570 on the tree stand 520.

Thus, as discussed herein, the embodiments of the present invention relate to a tree support and cover system. More particularly, the present invention relates to a tree stand and collapsible cover configured for efficient transportation and storage of a tree. The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

What is claimed and desired to be secured by Letters Patent is:

1. A method of covering a tree with a bag comprising the acts of:

providing a collapsed cylindrically-shaped bag comprising:

a top opening;

an overall diameter;

at least one adjustable lengthwise adjustable expansion system for modifying the overall diameter of the bag, the adjustable expansion system having two sides and a flexible baffle, said baffle being attached to both sides and spanning a gap between the two sides and extending to increase the diameter of the bag when sliding the bag over the tree and said baffle collapsing when the two sides of the adjustable expansion system are brought together to decrease the diameter of the bag to allow easier storage of the tree; and extending the collapsed cylindrically-shaped bag over a tree wherein the top opening is caused to pass over the tree from a bottom of the tree to a top of the tree;

closing the at least one adjustable opening to reduce the overall diameter of the cylindrically-shaped bag; and cinching the top opening of the cylindrically-shaped bag substantially closed to cover the tree.

2. The method of claim 1, wherein the act of extending the collapsed cylindrically-shaped bag up over a tree further includes grabbing a handle coupled to an upper portion of the cylindrically-shaped bag.

3. The method of claim 1, wherein the method can be performed by a single person.

4. The method of claim 1, wherein the piece of material prevents the tree from extending out of the adjustable opening as the bag is extended over the tree.

* * * * *